US005105861A

United States Patent [19]

Berger et al.

[11] Patent Number: 5,105,861

[45] Date of Patent: Apr. 21, 1992

[54] FILLING VALVE FOR THE PORTIONED DRAWING OFF OF FREEFLOWING PRODUCTS

[75] Inventors: Jörg Berger, Aachen; Franz-Willi Spelten, Wegberg; Rüdiger Emmerich, Grevenbroich; Hans Zaiss, Düsseldorf, all of Fed. Rep. of Germany

[73] Assignee: PKL Verpackungssysteme GmbH, Dusseldorf, Fed. Rep. of Germany

[21] Appl. No.: 530,650

[22] Filed: May 30, 1990

[30] Foreign Application Priority Data

Jun. 2, 1989 [DE] Fed. Rep. of Germany ..... 3918008

[51] Int. Cl.[5] ..... B67C 3/26; B65B 1/04

[52] U.S. Cl. ..... 141/250; 141/90; 141/392

[58] Field of Search ..... 141/250, 126, 263, 264, 141/258, 147, 90, 260, 392; 222/196, 198, 199, 408.5, 509; 239/102.1

[56] References Cited

U.S. PATENT DOCUMENTS

| | | | |
|---|---|---|---|
| 3,205,920 | 9/1965 | Cozzoli et al. | 141/90 |
| 4,691,843 | 9/1987 | Dunnan | 222/146 |
| 4,789,012 | 12/1988 | Hart | 141/18 |

FOREIGN PATENT DOCUMENTS

| | | |
|---|---|---|
| 1123545 | 9/1962 | Fed. Rep. of Germany . |
| 3229162 | 2/1984 | Fed. Rep. of Germany . |
| 3704901 | 8/1988 | Fed. Rep. of Germany . |

*Primary Examiner*—Ernest G. Cusick
*Assistant Examiner*—David J. Walczak
*Attorney, Agent, or Firm*—Marmorek, Guttman & Rubenstein

[57] ABSTRACT

The invention relates to a filling valve on a filling and closing machine with a filling container 1 for free-flowing products, in particular foodstuffs with lumpy ingredients. In order to prevent subsequent dripping or the formation of threads during the portioned drawing off of the free-flowing products, the filling valve has, in a mouthpiece, an axially movable valve slide 9 which, in the closed portion, can be set in vibration in the axial direction. The stroke of the vibration is dimensioned in such a manner that the closing function of the valve tappet 9 is maintained.

11 Claims, 4 Drawing Sheets

FILLING VALVE FOR THE PORTIONED DRAWING OFF OF FREEFLOWING PRODUCTS

The invention relates to a filling valve for the portioned drawing off of free-flowing products, in particular foodstuffs with lumpy ingredients, from a filling container of a filling and closing machine, with an axially movable valve tappet which is arranged in a mouthpiece and designed as a valve slide.

In the portioned drawing off of free-flowing products, in particular of such filling products with lumpy ingredients, into containers, it repeatedly happens that, after the closing of the filling valve in an uncontrolled manner, product residues, which lead to dirtying both of the machine and of the containers, adhere to the mouthpiece or to the valve tappet. The same problem occurs when viscous masses are to be drawn off. Upon the transportation of the containers, product residues in the form of threads are carried along.

There has been no shortage of attempts to avoid the problem of subsequent dripping and thread formation. It has been attempted, for instance, to bring about the separation of the product residues by means of a rapid closing movement of the valve tappet. It has also been attempted to solve the problem by means of rinsing with fluid or steam. In other solutions, the product to be drawn off, which is at the delivery end of the mouthpiece, is sucked back after completion of the filling process (DE 37 04 901 A1; DE 32 29 162 A1). All other solutions have the disadvantage that either the subsequent dripping rate is too high or else considerable process engineering outlay is necessary. In many cases, such solutions are, however, also unsuitable for other reasons, e.g. when the filling product is to be drawn off under aseptic conditions.

The aim of the invention is to produce a filling valve for the portioned drawing off of free-flowing products of the type referred to in the introduction, by means of which, with limited mechanical construction, subsequent dripping or thread formation can be reliably prevented upon the drawing off of free-flowing products.

This aim is achieved according to the invention in that the valve tappet is connected to a vibration unit, with which, in the closed position, the valve tappet can be set in vibration in an axial direction, with a stroke with which the closing function of the valve tappet is maintained.

In tests with the filling valve according to the invention it has emerged that, after the closing of the valve,, which is brought about by means of a rapid closing movement of the valve tappet, and the subsequent vibration, the product residues, which adhere to the valve tappet and which have not yet been separated by means of the impact upon closing, are shaken off by means of the vibration. This is always the case when the forces exerted on the product residues at the lower reversal point of the valve tappet are greater than the adhesion forces.

Particularly good results have been achieved when the valve tappet is subjected to certain movements. For instance, it has proved to be particularly favorable if, with a valve tappet of which the opening and closing stroke amounts to approximately 40 mm, the stroke upon vibration is 2 to 20 mm and the vibration frequency is up to 100 Hz, preferably 30 to 40 Hz, and the number of vibrations amounts to up to 50, preferably 0.5 (jolt) to 10. In the central closed position, the idle stroke until opening takes place must be smaller than half the stroke upon vibration, in order that the valve remains closed.

By means of the vibration, fibres and pieces, such as e.g. meat, vegetables etc., which are caught between the valve tappet and the tappet guide, are at the same time removed. It has further been observed that, according to the product, product residues not shaken off by means of the vibration settle uniformly on the underside of the valve tappet during the vibration time. This means that subsequent dripping is prevented in every case until the next filling operation.

The vibration unit can be in work connection with the valve tappet either directly on a valve rod of the valve tappet or via a reversing mechanism. In the latter case, the vibration unit can be arranged between a cylinder/piston unit for the opening and closing of the filling valve and a free arm of the reversing mechanism or else directly on a bridge-like bearing part of the reversing mechanism. The vibration unit can be of pneumatic, electro-pneumatic or electric design.

The vibration of the valve tappet which is brought about according to the invention in the direction of the closing movement makes it possible to keep the valve tappet in an accurately defined position at the end of the vibration process. This is important as the valve tappet must have a certain starting position for the opening or closing movement which follows.

From German Patent Specification 1,123545 a dosing device for chocolate mass and the like has already in fact become known, in which use is made of the prevention of subsequent dripping and the avoidance of thread formation of highly viscous relatively cold masses by means of the combined effect of an auxiliary reciprocating pump and a vibrator which sets the pouring mouthpiece, which is movably connected at the delivery opening of the dosing device, in high vibration during the intake stroke of the auxiliary pump. Apart from the fact that relatively high outlay is required there as a result of the necessary use of an auxiliary pump, in the known device the vibrator engages on the mouthpiece in such a manner that the latter is moved backwards and forwards in a horizontal direction. Whereas in the present invention only the valve tappet is thus moved up and down and the valve part, which serves as a tappet guide, remains still, in the known device the entire mouthpiece must be moved.

A preferred exemplary embodiment is represented in the drawing and is explained in greater detail below. In the drawing, FIG. 1 shows a filling device with a vibration system and a dosing piston in a vertical cross-sectional representation;

Figure 1:
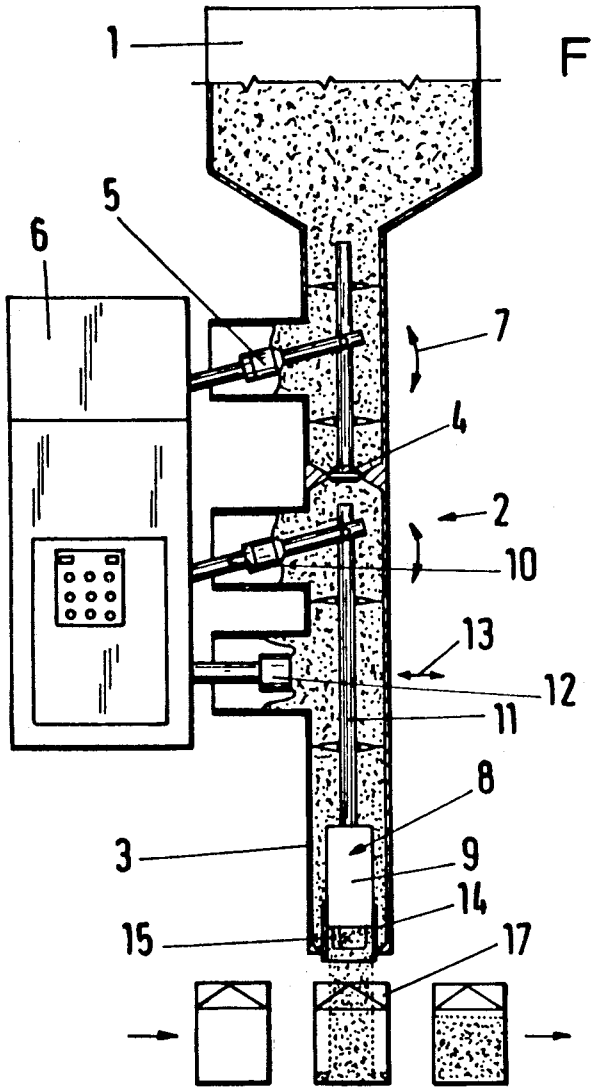

As can be seen from FIG. 1, in a filling station of a filling and closing machine which is not represented in detail, a product tank 1 is connected to a filling device 2 which has a housing with a mouthpiece 3. In the housing an induction valve 4 is arranged, which is connected via an operating lever 5 to a drive device 6 which is not represented in detail. The operating lever 5 can be moved in the direction of the double arrow 7. Below the induction valve 4, there is a filling valve 8 which is composed of a valve tappet 9, designed as a valve slide, a valve rod 11 and likewise an operating lever 10; the latter is in turn guided to the drive device 6. The drive of the filling valve is explained in greater detail below with reference to FIG. 4. In the area of the valve rod 11, there is a dosing piston 12 which is movably guided backwards and forwards in the direction of the double arrow 13.

Figure 3:
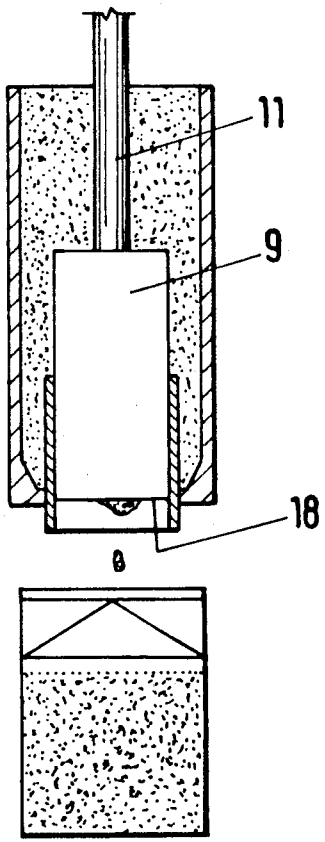
FIG. 3 shows a corresponding representation to FIG. 2, with the filling valve closed.
Figure 2:
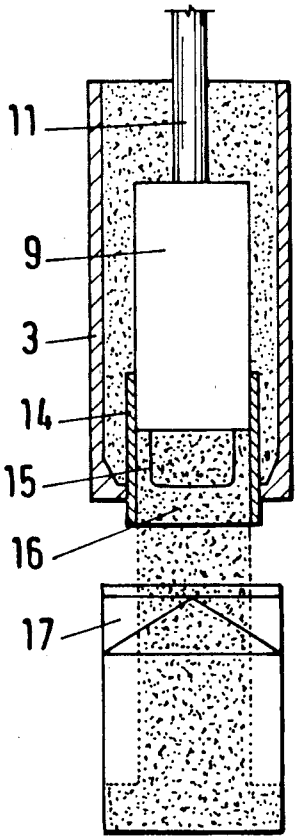
FIG. 2 shows on enlarged scale the lower end of the filling valve in the filling position.

The valve tappet 9 is designed as a so-called cutting tappet and, as can be seen from FIGS. 2 and 3, is guided in a tappet guide 14 which in turn is fitted in the mouthpiece 3. In the tappet guide 14, penetration openings 15 are provided laterally, by means of which, with the valve tappet 9 raised, the product can flow via the lower delivery opening 16 into a container 17 situated below it. As soon as the container 17 is full, the valve tappet 9 is moved downwards rapidly via the valve rod 11 and at the same time the lateral penetration openings 15 are closed, as is represented in FIG. 3. It can be seen from the same figure that product residues can adhere to the front 18 of the valve tappet 9. In order to shake these off or else also to distribute them uniformly on the underside of the tappet, the valve tappet 9 is set in vibration. According to the product to be drawn off, the vibration stroke can amount to 5 to 10 mm. Obviously the valve tappet 9 must not thereby expose the penetration openings 15. The vibration frequency and the number of vibrations differ according to the product. Good results with products containing lumpy items were achieved at 30 to 40 Hz and with a number of vibrations from preferably 0.5 to 4 vibrations. Half a vibration is in this connection to be understood as an upward jolt.

Figure 4:
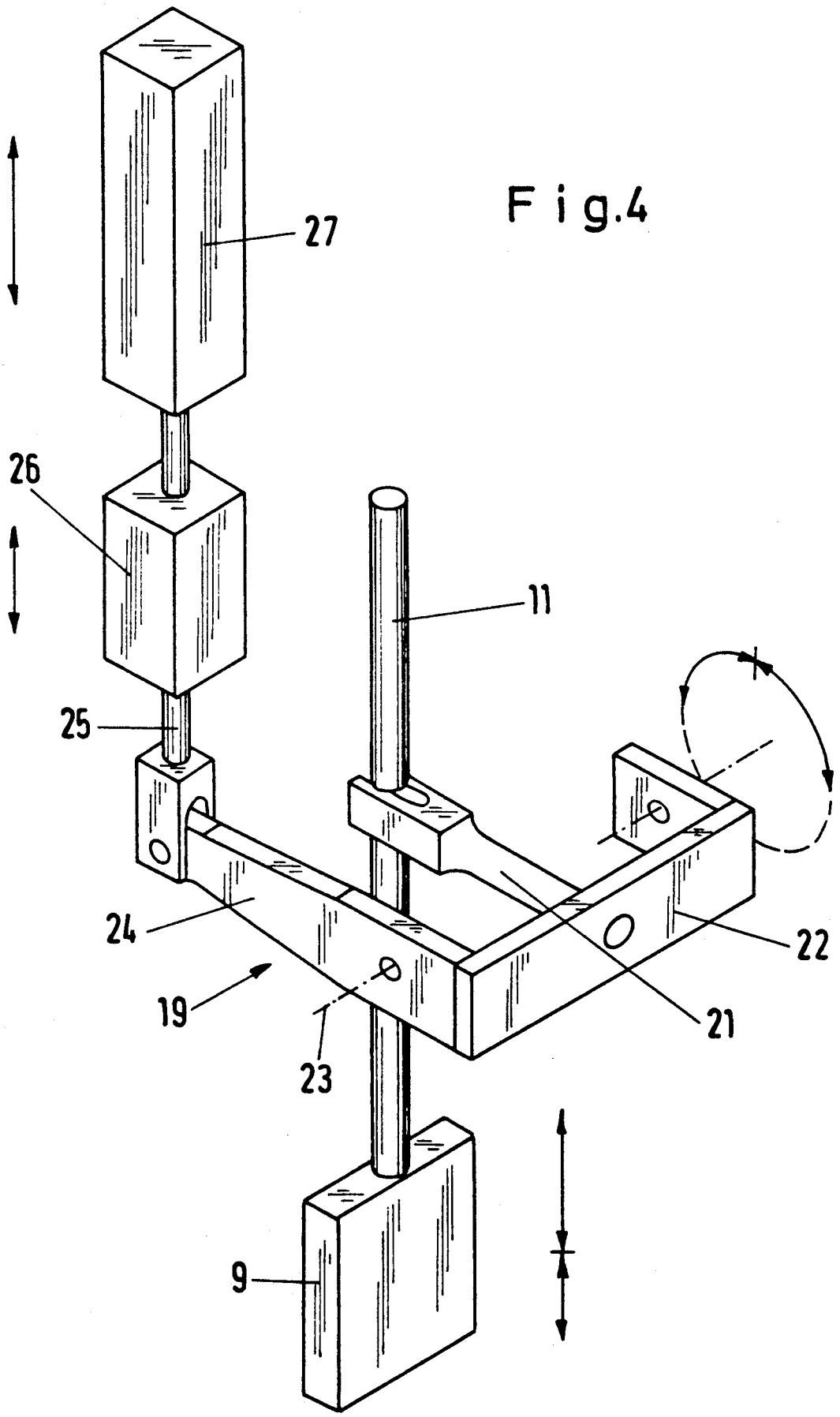
FIG. 4 shows a drive mechanism for the vibration system.

The drive for producing the vibration of the valve tappet 9 can be achieved in a suitable manner. A conceivable drive possibility is represented in FIG. 4. In this case, the valve tappet 9 is connected by means of the valve rod 11 to a reversing mechanism 19 which corresponds to the operating lever 10 of FIG. 1. This latter has a bridge-like bearing part 22 which is mounted pivotably about an essentially horizontal axis 23. The bearing part 22 also has an operating lever 21 for the valve rod 11 as well as a freely projecting arm 24. A vibration unit 26, which can be of pneumatic, electropneumatic or electric design, engages on this via an intermediate rod 25. Behind the vibration unit 26, there is another cylinder/piston unit 27 for opening and closing the valve tappet 9.

With the operating device according to FIG. 4, a single device thus both opens and closes the filling valve and also, after the closing process, sets the valve tappet 9 in vertical vibration movement by means of operation of the vibration unit 26.

Figure 5:
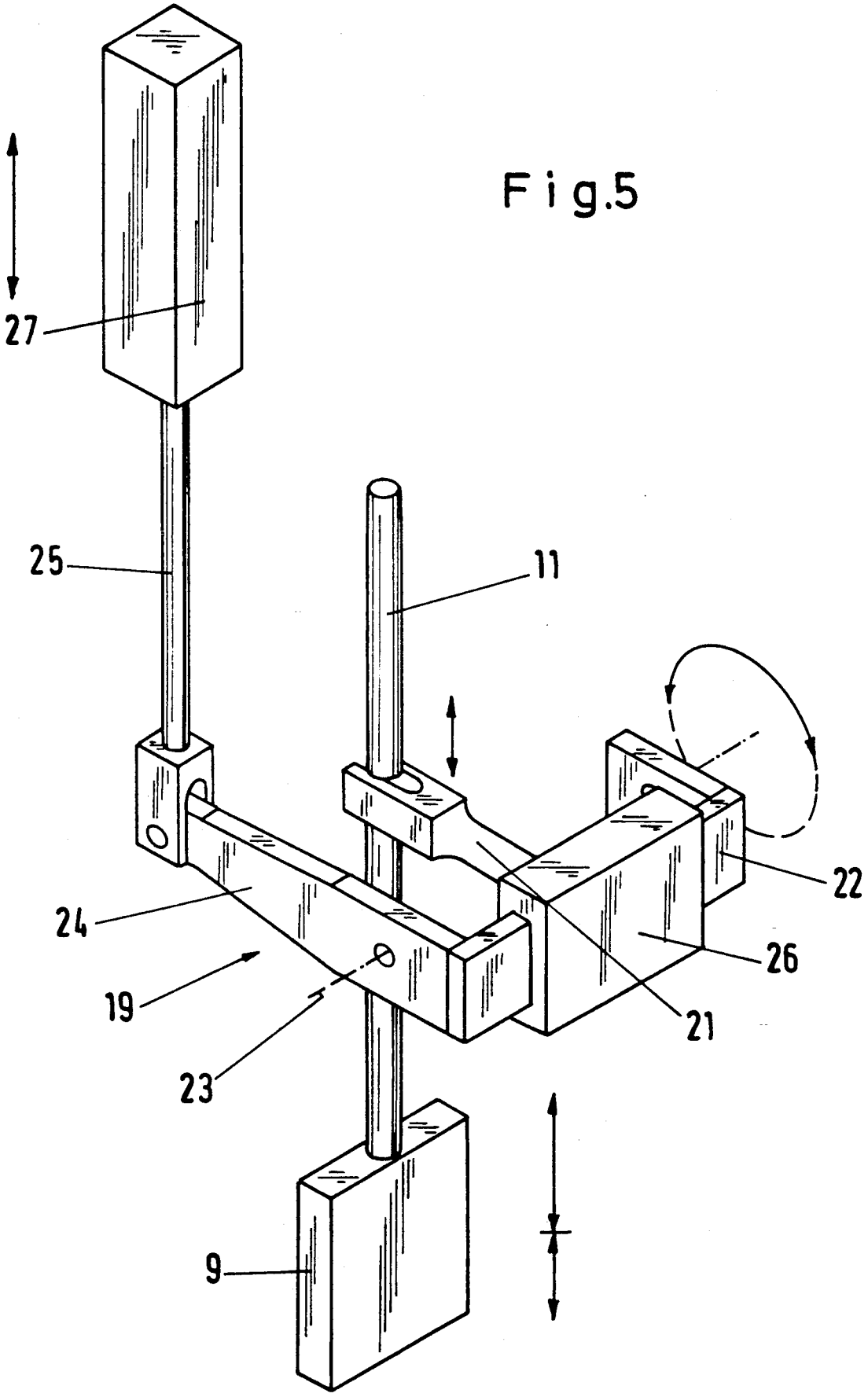
FIG. 5 shows a modified embodiment of the vibration device.

With the operating device according to FIG. 5, the vibration unit is arranged on the bridge-like bearing part 22 and performs the pivoting movement as well during the opening or closing process. The operating lever 21 is pivotably mounted and driven in the vibration unit. During the opening or closing movement, the operating lever 21 is held securely in a defined position in the vibration unit.

The advantage of this arrangement lies in the reduced vibrating mass (only lever, rod, tappet).

Figure 6:
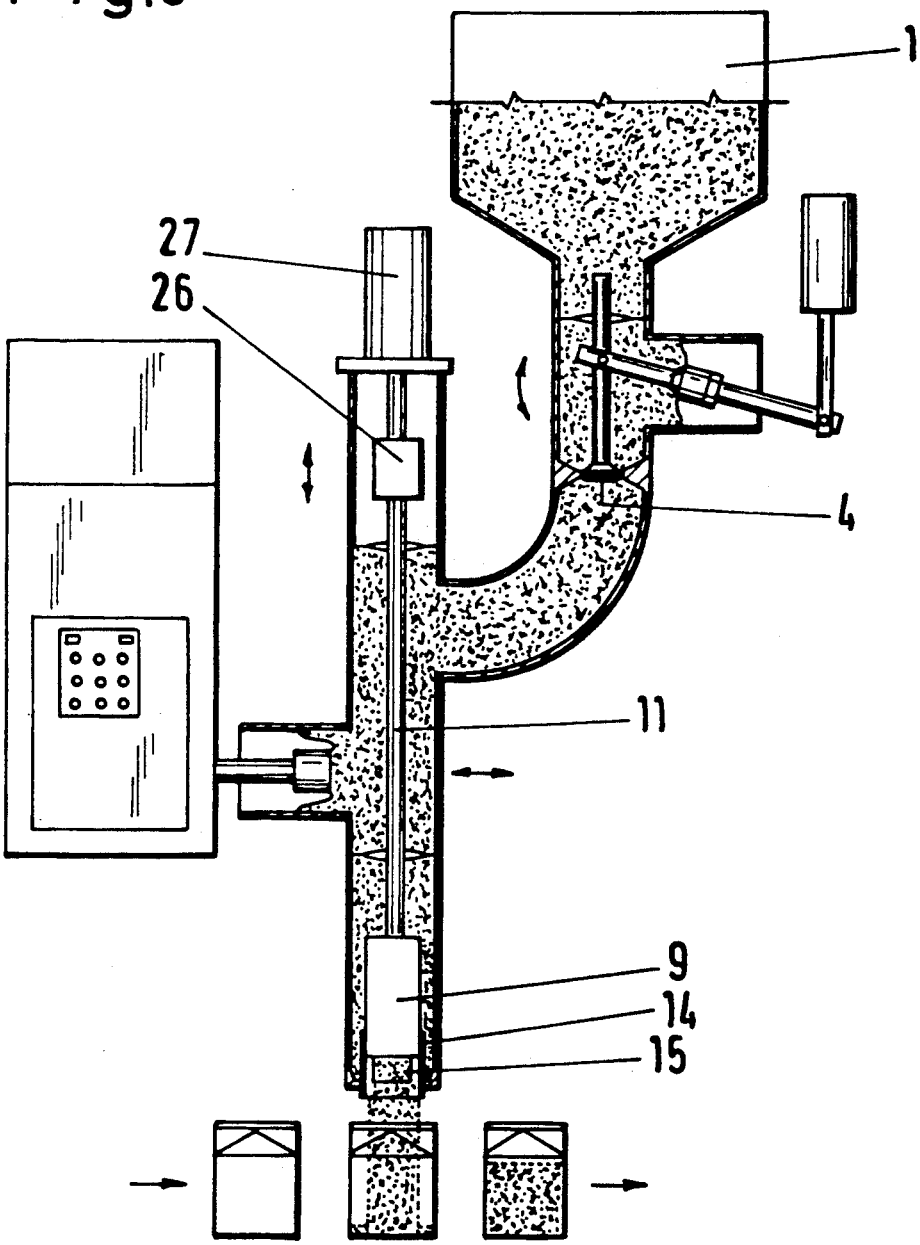
FIG. 6 shows a further alternative embodiment for the vibration device.

In FIG. 6, a modified embodiment of the filling device 2 is represented. The difference in relation to the embodiment according to FIG. 1 consists in the fact that the product tank 1 and the induction valve 4 with its drive are arranged in a laterally displaced manner. As a result, it becomes possible to arrange the vibration unit 26 and the cylinder/piston unit 27 for the drive of the valve tappet 9 directly on the valve rod 11 of the latter.

We claim:

1. A filling device for the portioned drawing off of freeflowing products from a filling container into a receptacle, comprising a housing terminating in a mouthpiece, an openable and closable valve assembly located in said mouthpiece through which said products are introduced into said receptacle, said valve assembly comprising a valve tappet and a tappet guide, said valve tappet being slidable in said tappet guide along an axial direction between open and closed positions, and vibration means connected to said valve tappet for setting said valve tappet into vibration when said valve assembly is closed with a stroke along said axial direction which is insufficient to bring said valve tappet into an open position so that said valve assembly remains closed throughout said stroke.

2. The filling device of claim 1 further comprising a valve rod connected to said valve tappet, and means connected to said valve rod for opening and closing said valve assembly.

3. The filling device of claim 2 wherein said means for opening and closing said valve assembly comprises a cylinder/piston unit.

4. The filling device of claim 3 wherein said vibration means is connected to said valve rod.

5. The filling device of claim 4 wherein said vibration means is mounted on said valve rod.

6. The filling device of claim 3 wherein said vibration means is connected to said valve rod via a reversing mechanism.

7. The filling device of claim 6 wherein said reversing mechanism comprises a freely projecting arm connected to said piston/cylinder unit, and a bridge-like bearing part connected to said valve rod.

8. The filling device of claim 7 wherein said bridge-like bearing part is mounted pivotably about an essentially horizontal axis and is connected by means of a lever to said valve rod.

9. The filling device of claim 7 wherein said vibration means is located between said piston/cylinder unit and said freely projecting arm of said reversing mechanism.

10. The filling device of claim 7 wherein said vibration means is mounted on said bridge-like bearing part of said reversing mechanism.

11. The filling device of claim 1 wherein said tappet guide has penetration openings therein, said valve assembly being opened when said valve tappet uncovers said penetration openings and said valve assembly being closed when said valve tappet covers said penetration openings.

* * * * *